United States Patent [19]

Bleh

[11] Patent Number: 4,696,736

[45] Date of Patent: Sep. 29, 1987

[54] DEVICE FOR WASHING OUT ORGANIC LOAM-LIKE IMPURITIES FROM CONTINUOUSLY FED LARGE AND FINE GRANULAR SOLIDS

[76] Inventor: Klaus Bleh, Meckenheimer Strasse 6, 6701 Rodersheim-Gronau 1, Fed. Rep. of Germany

[21] Appl. No.: 852,843

[22] Filed: Apr. 16, 1986

[30] Foreign Application Priority Data

May 18, 1985 [DE] Fed. Rep. of Germany ..... 3517982

[51] Int. Cl.[4] ..... B03D 1/00

[52] U.S. Cl. ..... 209/173; 209/210; 209/430

[58] Field of Search ..... 209/644, 172, 172.5, 209/173, 183, 184, 192, 193, 428, 429, 458, 460, 480, 488, 430, 208, 481, 210

[56] References Cited

U.S. PATENT DOCUMENTS

| | | | |
|---|---|---|---|
| 228,915 | 6/1880 | McColl | 709/428 |
| 1,316,038 | 9/1919 | Jackson | 209/429 |
| 2,929,502 | 3/1960 | Harris | 209/173 |
| 4,052,299 | 10/1977 | Rohr | 209/430 |
| 4,055,488 | 10/1977 | Siri et al. | 209/173 |
| 4,092,229 | 5/1978 | Bhattacharya | 209/173 X |
| 4,169,787 | 10/1979 | Gunnerson | 209/173 |
| 4,357,154 | 11/1982 | Harting | 209/173 |

FOREIGN PATENT DOCUMENTS

| | | | |
|---|---|---|---|
| 916244 | 9/1945 | France | 209/173 |

*Primary Examiner*—Robert B. Reeves
*Assistant Examiner*—Glenn Foster
*Attorney, Agent, or Firm*—Kinzer, Plyer, Dorn, McEachran & Jambor

[57] ABSTRACT

The device has an endless conveyor belt 29 supported on support rollers 17, 18, 18', 6, 32, 32, 7, which forms a washing trough 30, to which the material to be washed is fed via a chute 12. The device is mounted on a machine frame 1, which comprises individual supports 2 and 26. The entire device is fixed to a rectangular base frame 3 surrounding the device, which is pivotally arranged at one end transversely to the direction of travel 10 of the conveyor belt 29 on a bearer 4 and axles 5, while on the opposite side/end is fitted a height adjustment mechanism between the device or the frame 26 and the base frame 3.

4 Claims, 3 Drawing Figures

Figure 1:
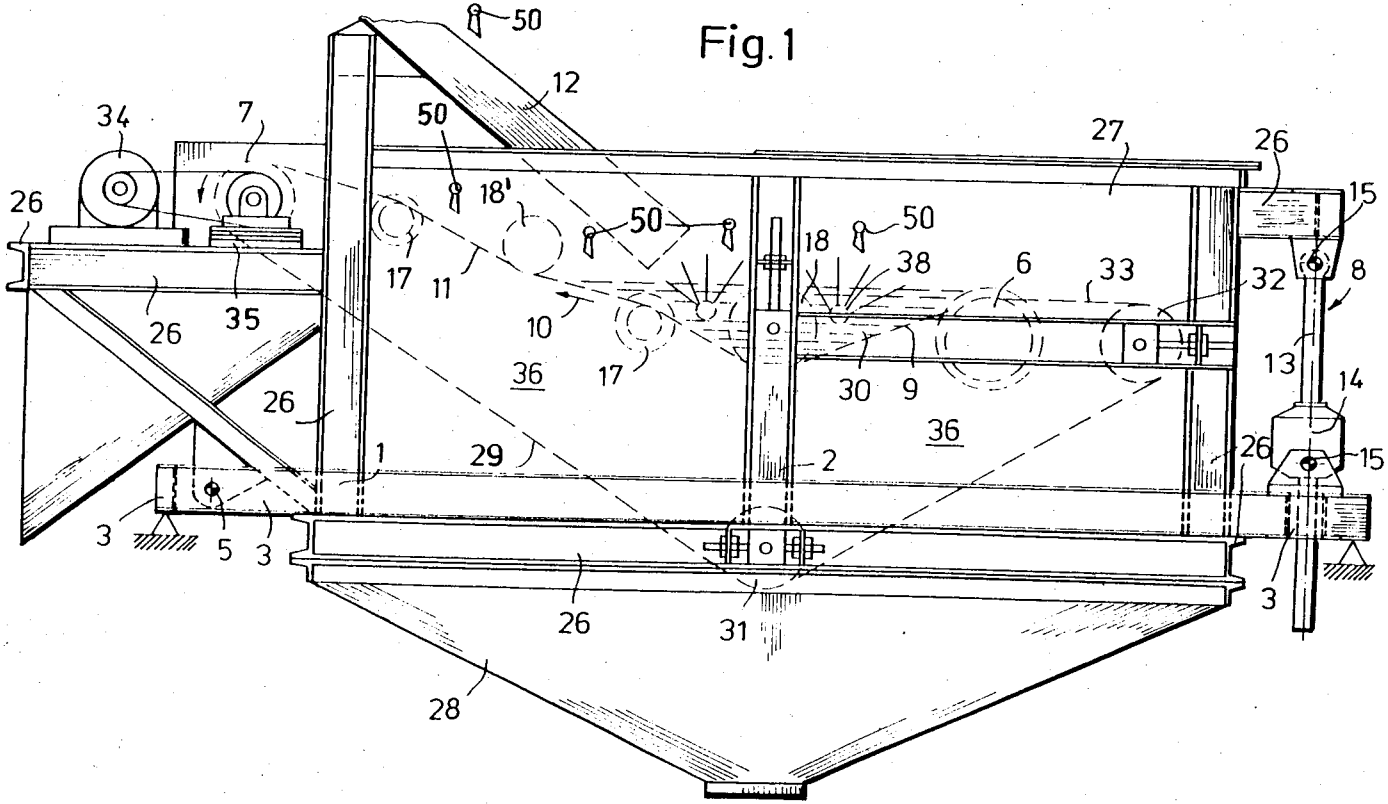

DEVICE FOR WASHING OUT ORGANIC LOAM-LIKE IMPURITIES FROM CONTINUOUSLY FED LARGE AND FINE GRANULAR SOLIDS

The invention relates to a device for washing out organic and loam-like impurities from continuously fed large and fine granular solids, such as freshly dredged-/excavated and prepared gravel, having a chute feeding the material to a washing trough/pan and spray jets for the washing fluid, consisting of an endless conveyor belt supported on support rollers, which are retained in the machine frame such that an initial part of the conveyor belt is arranged down stream of the chute and is provided as a washing trough/pan, and that the other part of the conveyor belt is arranged to rise up/incline up beneath the chute and aginst the direction of flow of the fed material, whereby the conveyor belt is driven opposite to the direction of flow of the material fed over the chute, that the conveyor belt at the centre support of the machine frame is height-adjustably guided on to an upper/overhead pressure roller and a deflecting roller for the initial part of the conveyor belt is coupled to this pressure roller, which is associated to a further outbound return roller, whereby an horizontal running section of the conveyor belt is provided between the return rollers and that the outer return roller of the section of belt situated beneath the chute is height adjustable.

A device having these features is already known (DE-PS No. 2 542 940) and U.S. Pat. No. 4,052,299, whereby the conveyor belt designed as a smooth belt is arranged at both end faces tightly between adjacent end sections of the casing/frame. By changing the conveying speed of the belt, or changing the angle of inclination of the chute, or the inclination of the belt sections, or the angle of the spray jets of the water and by changing the speed of the spray jet and its pressure the device can be set for any degree of contamination present, as well as for the particular type of material. The depth of the washing trough is altered primarily by adjusting the pressure roller fitted to the centre stand, whereby a small flow rate is obtained for a large depth, and, conversely, a greater flow rate for a limited depth. However as a result, the separation of fine sand is affected. The machine must be set to the composition of the conveyed material and, should the composition of the conveyed material change, it would be necessary to make adjustments to the machine each time in order to alter the dimension of the washing trough. This incurs a considerable expenditure whereby the machine has to be stopped and the various return rollers on the conveyor belt have to be positionally adjusted.

The object of the invention is to alter the effect of the separation section using an infinitely variable means of adjustment after anticipation of a basic setting, without altering the pass-over height, width and speeds enabling the variation in material to be constantly met.

This tank is resolved according to the invention by the fact that the machine frame is mounted on a base frame, that the machine frame on one end of the base frame is located transversely to the direction of travel of the conveyor belt on a bearer, and that the machine frame is arranged on a height adjusting mechanism at the opposite end.

An advantageous embodiment exists in that a threaded spindle is provided, located in the machine frame and in the base frame, which can be driven by a geared motor.

Furthermore, it is advantageous that an hydraulic or pneumatic lifting unit or a tensional rope drive is provided as a height adjustment mechanism.

In addition, it is proposed that the settings of the height adjustment mechanism are determined/established via limit switches, photo-electric cells, proximity switches or similar.

A basic setting is initially made on the machine, where by the height adjustable pressure roller is set to its lowest position so that a washing trough is effected for which the entire fine material, namely the fine sand, raw minerals and similar is retained. The depth of the bed can be altered from this basic setting by lowering or raising the complete machine frame so that an immediate response for changing the fine sand quota in the feed or the sand-water mixture is possible, without the machine having to be stopped.

The invention is explained in the following description with the aid of an example depicted in the drawings.

Shown are:

FIG. 1 an embodiment of the invention in elevation.

Figure 2:
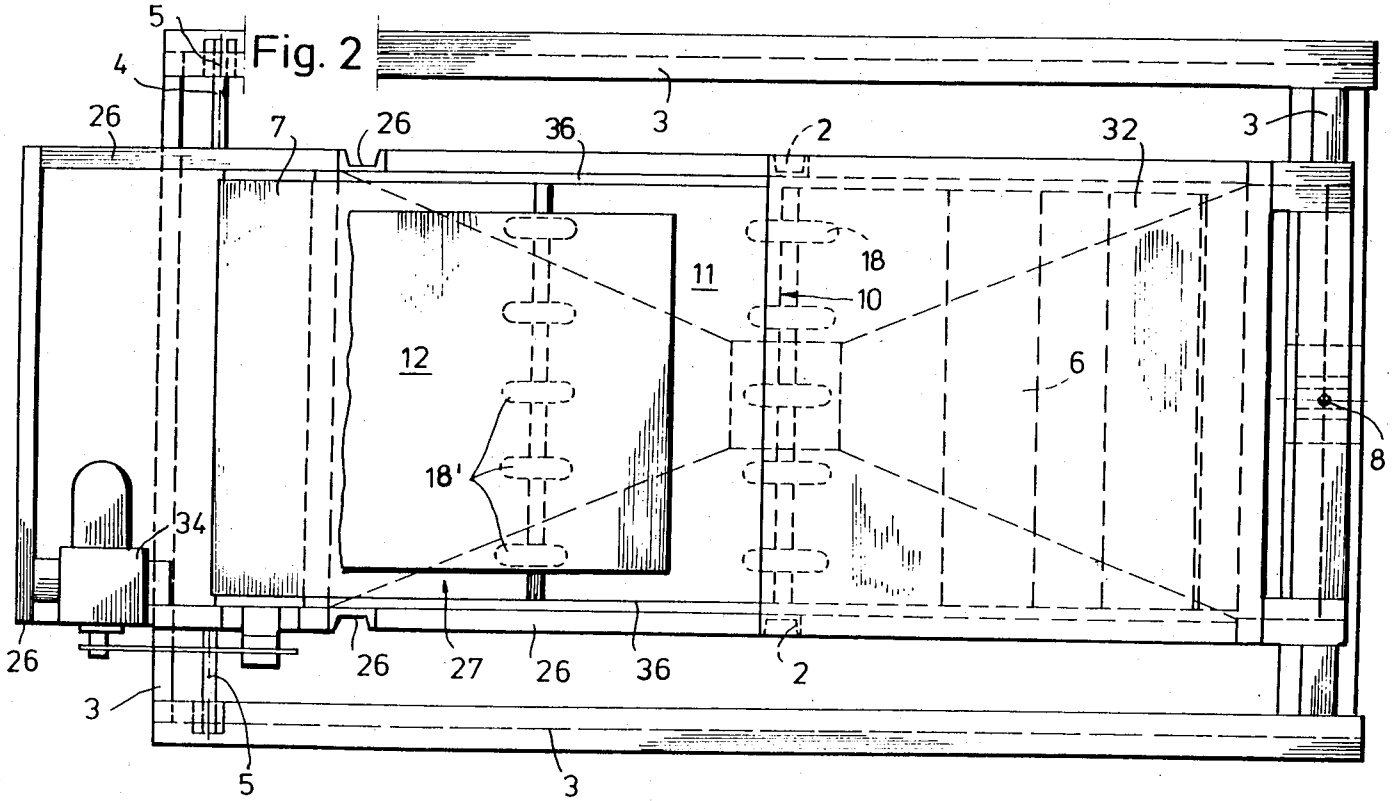

FIG. 2 a plan view of FIG. 1 and

Figure 3:
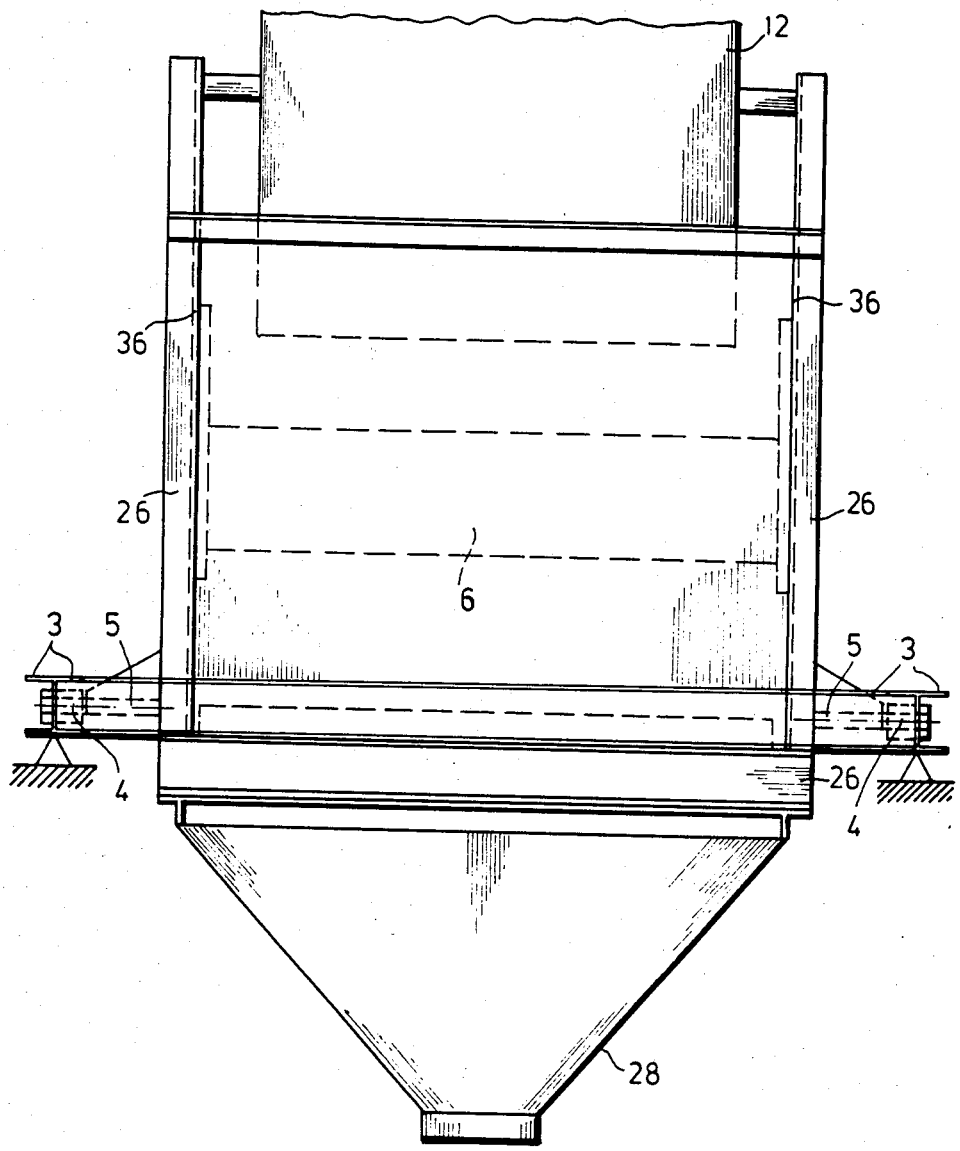

FIG. 3 a side view of FIG. 1.

The device shown in the drawings has a machine frame 1, which comprises supports 2, 26, which are lined with an internal lining to form a vessel 27 having a wooden water discharge hopper 28. Pressure and return rollers are located in the individual supports 2, 26, in order to guide a conveyor belt 29. For the actual washing operation, the upper part of the conveyor belt 29 is used, whereby a section 9 of the conveyor belt 29 arranged downwards from the chute 12 forms the actual washing trough 30, and a further section 11 of the conveyor belt 29 beneath the chute 12 is arranged to rise up/incline up in a counter direction to the flow of the fed material. There are brakes in the region of the section 11. The endless conveyor belt 29 is supported off the upper pressure roller 18 on the centre support 2 and underneath on a return roller 31, whereby the pressure roller 18 is height adjustable. In the region of section 9 the conveyor belt 29 is guided over a deflecting roller 6 and a further outbound return roller 32, which serves as a tension roller at the same time, whereby a horizontal section 33 of the conveyor belt 29 is provided between the rollers 6 and 32.

This horizontal section 33 of the conveyor belt 29 is designed as a section through which the material passing can settle (i.e. a section of non-turbulent activity). The physical effect of this non-turbulence section ensures that for the separation of large and fine granular solids (gravel, sand and similar) from the impurities, the friction between the conveyor belt and the granular solids to be cleaned is greater than the counter-force brought about by the washing medium. The washing medium consequently carries away all the particles to be separated, which as a result of their specific gravity float in the liquid, such that the opposing frictional force created by the the conveyor belt 29 fails to carry along these particles. In the horizontal region of the conveyor belt 33, a thin film of liquid forms, which enables fine sand to be retained to a large extend, that means, not floated out with the impurities. The extraction of fine sand can be influenced by altering the depth of of the washing trough 30. The depth of the washing trough can be altered by adjusting the pressure roller 18 or even by adjusting the roller 7. However, in addition, a number of settings are necessary each time, among others, the adjustment of roller 31, which is expensive/-time consuming and leads to down times of the equipment.

The section 11 situated beneath the chute 12 is guide din a king of wave action over support rollers 17 and pressure rollers 18' and finally over a return roller 7 serving as a drive roller powered by the drive motor 34. The drive roller 7 is, for example, height adjustable with the aid of sub-plates 5. The conveyor belt 29 is driven against the direction of flow of the material fed over the chute 12. The conveyor belt 29 is situated between the side walls 36 of the material collecting vessel 27. In the washing trough 30 are situated further jets 38, which support the floating of the light weight materials.

This entire device/equipment described so far is mounted on a rectangular base frame 3. The device is thus supported at one end, i.e. transversely to the direction of the conveyor belt 29 on a bearer 4, whereby this bearer has an axle journal 5 and the complete device can pivot vertically around this axle. On the opposite side of the device it is supported on a height adjustment mechanism 8, which can be designed in various ways. In example depicted in the drawings a threaded spindle 13 is fitted between a support 26 on the device and the base frame 3, which is driven via a geared motor 14, whereby the threaded spindle 13 on the support 26 and the base frame 3 is fixed to articulations 15 in each case.

Instead of a height adjustment mechanism 8 of this type a pneumatic or hydraulic lifting unit can, for example, be used as well. It is, for example, even possible to suspend the entire device from a tensional rope drive. By changing the inclination of the device, whereby the whole device is pivoted around the axle 5, the depth of the washing trough 30 can be altered and also the flow rate of the washing medium.

The function is briefly explained with an aid of an example. Natural sand contains fine grains of 0.25 mm up to approx. 50%. Since in the production of mixed sand for the concrete industry a proportion of aobut 10 to 20% is required, the machine must be correspondingly set so that fine sand to some extent is carried away with the impurities, i.e. over the belt section 9, whilst the required mix is retrieved via the belt section 11. If the fine sand quota changes, then the depth of the washing trough must be adjusted to suit these conditions. By appropriate markings on the height adjustment mechanism 8 these values can be established so that the operator can find his bearings. The various settings can, however, be established via limit switches, photo-electric cells or poximity switches, and when required called up. As a result, the possibility exists for the machine to adjust automatically to the various operating conditions.

I claim:

1. A device for washing out organic and loam-like impurities from continuously fed large and fine granular solids, such as freshly dredged/excavated and prepared gravel, having a chute (12) feeding the material to a washing trough (30), and spray jets for establishing a flow rate of washing fluid, an endless conveyor belt (29) supported on support rollers located in the machine frame (1), an initial part (9) of the conveyor belt (29) in the direction of the material flow in the chute (12) providing the washing trough (30) with a second part (11) of the conveyor belt (29) beneath the chute (12),, said second part (11) being inclined upwards, the conveyor belt (29) being driven against the direction of flow of thematerial fed over the chute (12), and the conveyor belt (29) being height adjustably guided at the centre support (2) of the machine frame (1) by an upper pressure roller (18) to vary the depth of said trough (30) a deflecting roller (6) adjacent this pressure roller (18) for said initial part (9) of the conveyor belt (29), with which a further outboudn return roller (32) is associated within the machine frame (1), a section (33) of the conveyor belt (29) running horizontally is provided between the deflecting roller and the outbound return roller (6, 32) for retaining fine particles, and in which an outer return roller (7) of the belt section (11) situated beneath the chute (12) a machine frame (1,2,26) is pivotally mounted at one end on a base frame (3) by a journal axle bearer (4) extending transversely to the direction (10) of the conveyor belt (29), and the machine frame (1,2,26) is coupled at the opposite end to a height adjustment mechanism (8) whereby upon adjustment of said height mechanism (8) the inclination of the machine frame may be altered about the journal axle bearer and thereby the flow rate from the trough may be changed independently of aforesaid variance in the depth of said trough (30) thereby enabling more retention of fine particles on section (33) upon adjustment to less inclination about said journal axle bearer (4) and less retention upon adjustment to more inclination.

2. A device in accordance with claim 1, characterized in that a threaded spindle (13) is provided in the machine frame (1,2,26) and the base frame (3) as a height adjustment mechanism, which is operable by a geared motor (14).

3. A device in accordance with claim 1, characterized in that a fluid lifting unit is provided as a height adjustment mechanism.

4. A device in accordance with claim 1, characterized in that a rope drive is provided as a height adjustment mechanism.

* * * * *